US007159280B2

(12) United States Patent
Voshell, Sr. et al.

(10) Patent No.: US 7,159,280 B2
(45) Date of Patent: Jan. 9, 2007

(54) DISPOSABLE FALLER BAR WITH IMPROVED CORE

(76) Inventors: William E. Voshell, Sr., 722 Cannon Dr., Ringgold, GA (US) 30736; Keith Battersby, Unit G, Parkhouse Road Industrial Estate, Parkhouse Road, Low Moor Bradford, West Yorkshire BD12 0QA (GB); Colin Rhodes, Unit G, Parkhouse Road Industrial Estate, Parkhouse Road, Low Moor Bradford, West Yorkshire BD12 0QA (GB)

( * ) Notice: Subject to any disclaimer, the term of this patent is extended or adjusted under 35 U.S.C. 154(b) by 230 days.

(21) Appl. No.: 10/969,261

(22) Filed: Oct. 20, 2004

(65) Prior Publication Data

US 2005/0278899 A1 Dec. 22, 2005

Related U.S. Application Data

(60) Provisional application No. 60/512,722, filed on Oct. 20, 2003.

(51) Int. Cl.
*D01H 5/04* (2006.01)

(52) U.S. Cl. ..... 19/129 R; 19/129 A

(58) Field of Classification Search ..... 19/115 R, 19/129 A, 129 R

See application file for complete search history.

(56) References Cited

U.S. PATENT DOCUMENTS

| | | | | |
|---|---|---|---|---|
| 4,344,208 | A * | 8/1982 | Kunig | 19/129 R |
| 4,364,154 | A | 12/1982 | Rushworth | |
| 4,532,678 | A * | 8/1985 | Kunig | 19/129 R |
| 5,201,098 | A * | 4/1993 | Egerer | 19/129 R |
| 5,367,747 | A | 11/1994 | Shofner et al. | |
| 5,483,844 | A | 1/1996 | Shofner et al. | |
| 5,491,876 | A | 2/1996 | Shofner et al. | |
| 2002/0069504 | A1 | 6/2002 | Shaw | |

* cited by examiner

*Primary Examiner*—Gary Welch
*Assistant Examiner*—Andrew W. Sutton
(74) *Attorney, Agent, or Firm*—Howard & Howard Attorneys, P.C.

(57) ABSTRACT

A faller bar assembly includes a support member that defines a generally annular shaft. A sleeve defines a tubular wall with a generally annular opening and receives the generally annular shaft. The sleeve includes a rib that projects outwardly from the tubular wall and supports a plurality of combing needles. The rib includes a rib wall disposed within a plane defined by an axis of the generally annular opening. The rib wall defines an intermediate surface with the tubular wall having an angle of between 40 and 55 degrees to the plane defined by the axis.

20 Claims, 2 Drawing Sheets

DISPOSABLE FALLER BAR WITH IMPROVED CORE

PRIOR APPLICATIONS

This application claims priority to U.S. Provisional Patent Application No. 60/512,722 filed on Oct. 20, 2003.

FIELD OF THE INVENTION

The present invention relates generally to a drafting machine used for combing a sliver mass of fibrous material to make yarn. More specifically, the present invention relates to an improved faller bar for use in the drafting machine.

BACKGROUND OF THE INVENTION

During the manufacturing of yarn products, slivers of fibrous material, disposed in a tangled mass, must be combed to orient the individual fibers in a generally uniform direction. To orient the individual fibers in a generally uniform direction, the sliver mass is combed by a series of faller bars, typically numbering 144. A typical faller bar includes a plurality of combing needles, similar in appearance to a hair comb, that comb the sliver mass to orient the individual fibers in the generally uniform direction. Forces are generated upon the faller bar by pulling the sliver mass through the series of faller bars. These forces are known to break and bend the combing needles on a frequent basis.

Previously, faller bars have been manufactured entirely out of metallic substrates where the combing needles are mounted in the metallic substrate. The metallic faller bar is known to be expensive and difficult to replace when damaged. Therefore, disposable faller bars have been introduced to the industry to reduce the cost of replacing damaged faller bars. Known replaceable faller bars include a support member defining a generally angular shaft having a diameter of less than 6 mm. The sleeve typically includes a rib projecting outwardly that supports a plurality of combing needles used to orient the individual fibers of the sliver mass as set forth above. A sleeve defines a tubular wall having a generally annular opening that receives the support member. Problems with this design arise due to the narrow diameter, of about 6 mm or less of the support member. The faller bar is known to flex and break due to the narrow diameter of the support member. One such faller bar is disclosed in United States Patent Application No. 2002/0069504 where the disclosed support member has a narrow diameter to provide enough sleeve wall thickness to enable the sleeve to be molded over the support member.

In addition, a flexing faller bar has also resulted in defects in the sliver mass. To reduce the amount of flexing characteristic of presently available faller bars, a smaller sliver mass is introduced to the drafting machine, which results in reduced productivity. Because the limited space available inside a drafting machine, it has been impossible to increase the diameter of the support member due to the additional diameter of up to about 2 mm required of the sleeve.

The sleeve heretofore has required a tubular wall thickness of about 2 mm so that the polymers used to form the sleeve can flow through the sleeve mold without producing defects, such as, for example a void in the tubular wall resulting from inadequate flow of material. An increase in diameter of the support member has required the increase in diameter of the sleeve which results in a non-functional faller bar due to the lack of space inside the drafting machine.

Therefore, it would be desirable to produce a faller bar having a sleeve with narrower wall thickness so that an increased diameter of the support member can be introduced to the drafting machine.

SUMMARY OF THE INVENTION

A support member for a faller bar assembly includes a generally annular shaft. A sleeve defining a tubular wall with a generally annular opening receives a generally annular shaft of the support member. The sleeve includes a rib projecting outwardly from the tubular wall having a plurality of combing needles spaced therealong. The rib includes a rib wall disposed within a plane defined by an axis of the generally annular opening. The rib wall defines an intermediate surface with the tubular wall having an angle of between generally 40° and 50° to the plane defined by the axis.

In order to increase the diameter of the support member, the tubular wall of the sleeve must have a thinner cross section or wall thickness because the overall diameter of the assembly cannot increase. One reason prior art tubular wall thicknesses have exceeded 2 mm is primarily to allow polymer materials to flow through a plastic mold during the injection molding process. The inventive faller bar has provided a design that allows for the increase in the diameter of the generally annular shaft, which has unexpectedly increased the strength of the faller bar by over 100%. By adding 1 mm to the diameter of the annular shaft from 6 mm to generally 7 mm has increased the breaking strength from approximately 3,500 lbs. to approximately 7,000 pounds. However, in order to provide space for this increased generally annular shaft thickness within the drafting machine, the tubular wall thickness must be decreased by an equivalent amount.

Because prior attempts to mold the sleeve having a tubular wall thickness of about 1 mm or less has been unsuccessful due to the narrow die cavity, dimensional adjustments must necessarily to be made to the sleeve to improve the flowability of the polymer used to form the sleeve. Specifically, an intermediate surface disposed between the rib wall and the tubular wall has been added and was found to be necessary for molding a tubular wall having a thickness of about 1 mm or less.

It was determined that the intermediate surface disposed between the rib wall and the tubular wall must have an angular relationship with the plane defined by an axis of the tubular wall and the rib wall of between about 40° and 50°. An angle greater than about 50° requires more space of the sleeve than is available inside the drafting machine. An angle less than about 40° proved to be ineffective when trying to injection mold the tubular wall. Therefore, the unique dimensions of the present inventive faller bar assembly have proven effective in solving the problems associated with prior art disposable faller bar assemblies.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1A:
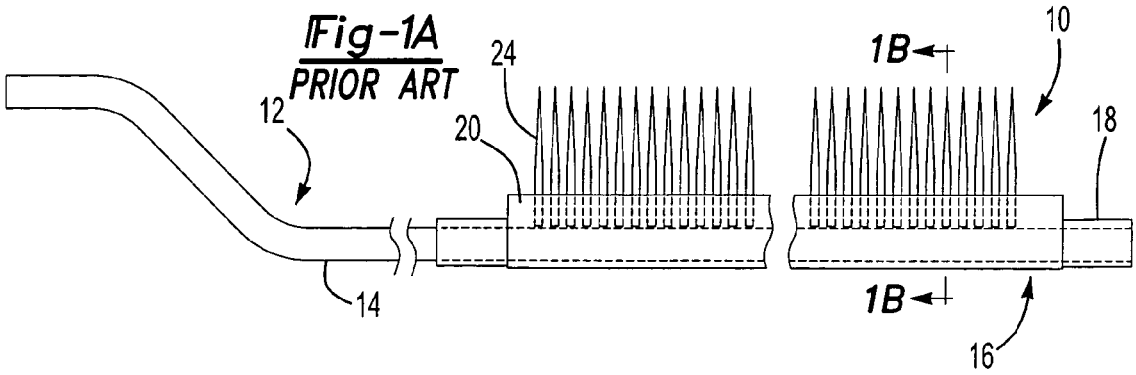
Fig-1A PRIOR ART
FIGS. 1*a* and 1*b* show a prior art disposable faller bar.
Figure 1B:
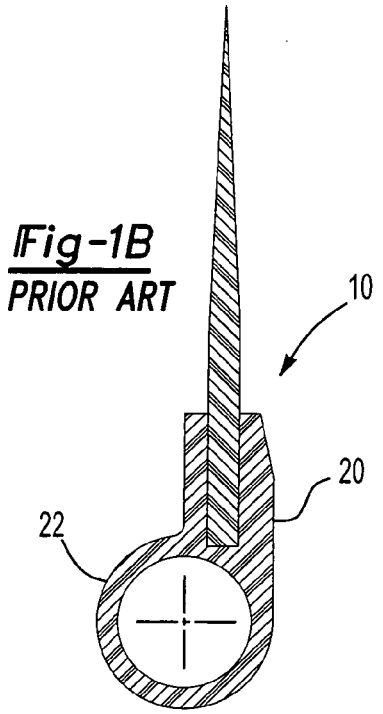
Fig-1B PRIOR ART

Referring to FIGS. 1*a* and 1*b*, a prior art faller bar is generally shown at 10 for use in a drafting machine (not shown). The faller bar 10 includes a support member 12 with an annular shaft 14 with a diameter of generally 6 mm or less.

A prior art sleeve 16 includes a plastic bearing surface 18 that receives the annular shaft 16. A rib 20 extends outwardly from the tubular wall 22. A plurality of combing needles 24 are spaced along the rib 20 for combing a sliver mass being processed in the drafting machine. The tubular wall 22 has a thickness of generally 2 mm when subtracting the inner diameter of the wall 22 from the outer diameter of the wall 22. Given the configuration of the assembly 10, this is the minimum wall thickness required to enable polymeric material to flow throughout the sleeve 16 during the molding process.

Figure 2B:
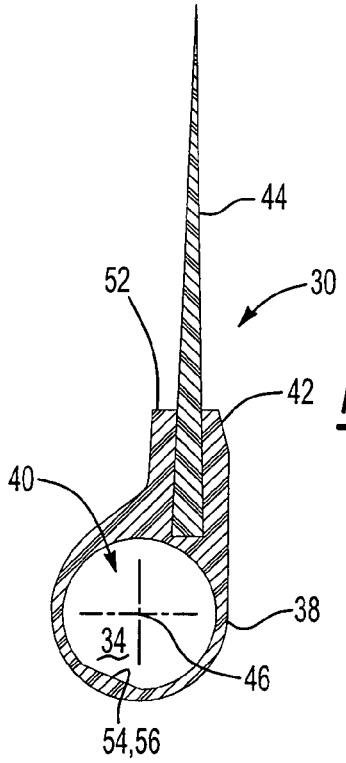
FIGS. 2*a* and 2*b* show one preferred embodiment of the faller bar of the present invention.
Figure 2A:
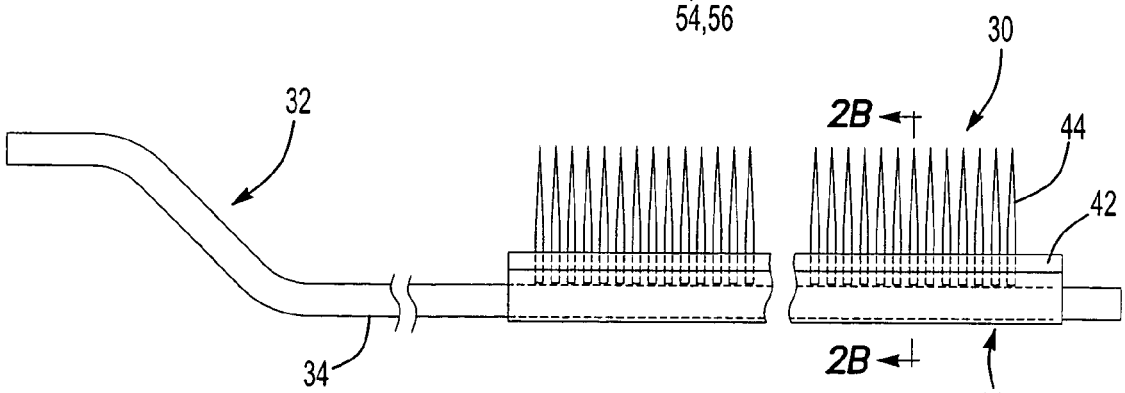

Referring now to FIGS. 2*a* and 2*b*, the inventive faller bar assembly is generally shown at 30. The inventive faller bar assembly 30 includes a support member 32 having a generally annular shaft 34.

A sleeve 36 defines a tubular wall 38 with a generally annular opening 40 for receiving the generally annular shaft 34 of the support member 32.

The sleeve 36 includes a rib 42 that extends outwardly from the tubular wall 38. A plurality of combing needles 44 are spaced along the rib 42. Various sizes of combing needles 44 may be used to achieve a desired result while combing the sliver mass being processed through the drafting machine. Up to around 72 combing needles 44 are integrally molded into the rib 42 in a spaced relationship. The density of the combing needles 44 is dependent upon the size of the combing needles 44 used. For example, larger combing needles 44 may have a density of 2.5 combing needles 44 per centimeter. A smaller combing needle 44 could include a density of up to 9 combing needles 44 per centimeter. Generally, larger combing needles 44 are used at the beginning of a combing process and smaller combing needles 44 are used at the end of a combing process. In certain circumstances, flat combing needles 44 are preferable and can be spaced along the rib 42 at a density of up to 789 combing needles 44 per centimeter.

Preferably, glass filled nylon 6 is used to mold the sleeve 36. The glass filled nylon 6 has produced durability characteristics that are desirable for the faller bar assembly 30. However, other polymers and other fillers such as Carbon fiber, and Impact modifiers can be used.

Figure 3:
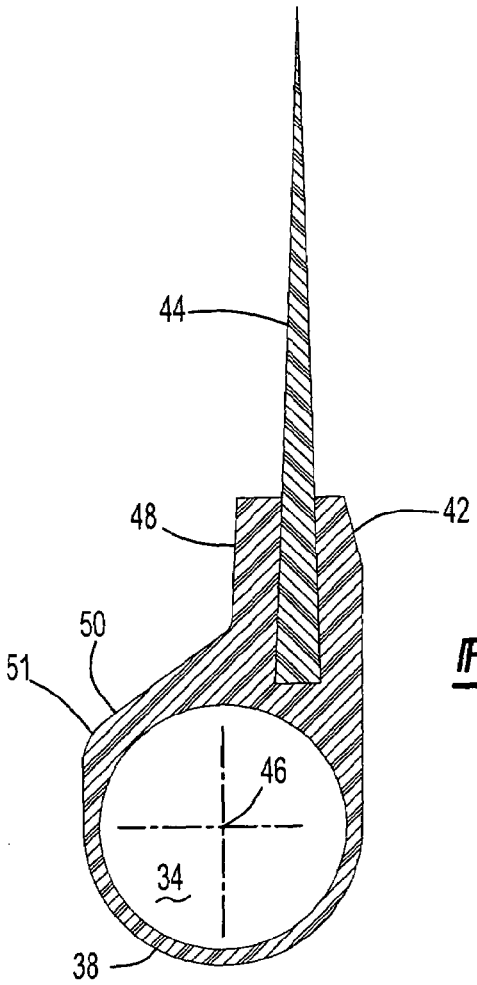
FIG. 3 shows a cross sectional view of an alternative embodiment of the present invention.

The annular opening 40 of the tubular wall 38 defines an axis 46 that is generally in the same plane of a rib wall 48 of the rib 42. The rib wall 48 defines an intermediate surface 50 with the tubular wall 38. The preferred polymer fill location 52 is located on the rib 42 at an end opposite of the transition surface 50. The transition surface 50 has proven to be desirable for polymer flow when forming the tubular wall 38 that includes a thickness of about 1 mm or less. This allows the increase in diameter of the shaft 34 by adding 1 mm to the increasing the diameter from about 6 mm to generally 7 mm, which has increased the breaking strength from approximately 3,500 lbs. to approximately 7,000 pounds. This produces a ratio between the shaft 34 and the sleeve 38 thickness of between generally 8 and 6 to 1. As stated above, when increasing the diameter of the generally annular shaft 34, the thickness of the tubular wall 38 must be decreased for the assembly 30 to fit into the drafting machine by keeping the assembly 30 at generally constant outer dimensions. The transition surface 50 defines an angle with the plane of the rib wall 48 of between generally 40° and 50°. More preferably, the transition surface 50 defines an angle of generally 45° with the plane of the rib wall 48. It has been proven that an angle of less than about 40° does not provide adequate polymeric flow through the mold die to form the tubular wall 38. It has also been proven that an angle greater than about 50° increases the size of the sleeve 36 to a level that does not allow the installation of the assembly 30 into the drafting machine. However, in some circumstance, and angle of about 55° has been shown to be desirable as shown in an alternative embodiment in FIG. 3. Producing a sharp transition corner 51 between the transition surface 50 and the tubular wall 38 having a sharper radius than that of the tubular wall 38 has also shown desirable results.

The tubular wall 38 defines a wall plane or inner, generally planar surface 54 inside the annular opening 40. The generally annular shaft 34 defines a shaft planar surface 56 that is positioned in an abutting relationship to the wall planar surface 54. The abutment of the wall planar surface 54 and the shaft planar surface 56 prevents the shaft 34 from spinning inside the annular opening 40 producing an improved torque resistance to the assembly 30.

Figure 4:
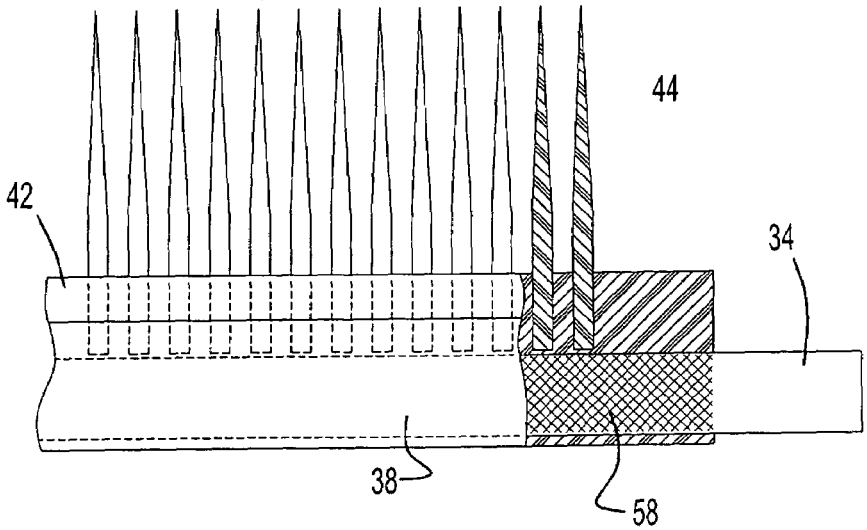
FIG. 4 shows a further alternative embodiment of the present invention.

Alternatively, the annular shaft 34 is knurled or otherwise scored as shown in FIG. 4 to improve torque resistance for preventing the tubular wall 38 from slipping on the annular shaft 34. The knurling region 58 preferably extends along the annular shaft 34 the full length of the tubular wall 38. The knurling region provides scoring on the surface of the annular shaft 34 having diamond, straight, slanted, or a curvilinear configuration to produce an increased torque resistance. During the injection molding process, the polymer used to form the sleeve 36 fills the voids in the annular shaft 34 formed during the knurling process, which results in increased torque properties for the assembly 30.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, wherein reference numerals are merely for convenience and are not to be in any way limiting, the invention may be practiced otherwise than as specifically described.

What is claimed is:

1. A faller bar assembly, comprising:

a support member defining a generally annular shaft;

a sleeve defining tubular wall with a generally annular opening for receiving said generally annular shaft;

said sleeve including a rib projecting outwardly from said tubular wall and having a plurality of combing needles spaced therealong; and wherein said rib includes a rib wall disposed within a plane defined by an axis of said generally annular opening, said rib wall defining an intermediate surface with said tubular wall having an angle of between generally 40° and 55° to said plane defined by said axis.

2. An assembly as set forth in claim 1, wherein said generally annular shaft includes a shaft planar surface and said tubular wall defines an inner wall planar surface positioned in an abutting relationship with said shaft planar surface.

3. An assembly as set forth in claim 1, wherein said sleeve comprises a polymeric substrate.

4. An assembly as set forth in claim 3, wherein said polymeric substrate includes strengthening agents.

5. An assembly as set forth in claim 1, wherein said combing needles are retained by said rib.

6. An assembly as set forth in claim 5, wherein said coming needles are integrally molded with said rib.

7. An assembly as set forth in claim 1, wherein said support member comprises a metallic substrate.

8. An assembly as set forth in claim 1, wherein said tubular wall includes a wall thickness of between generally 1.1 mm and generally 0.9 mm.

9. An assembly as set forth in claim 8, wherein said shaft includes a shaft diameter of between generally 6.2 mm to generally 7.0 mm.

10. An assembly as set forth in claim 1, wherein said shaft includes a knurled surface interfacing with said sleeve thereby providing an improved torque resistance.

11. An assembly as set forth in claim 1, wherein said intermediate surface defines an angle with said plane defined by said axis of generally 45°.

12. A faller bar assembly for use with a drafting machine, comprising:

a support member defining a diameter and being circumscribed by a sleeve having a sleeve thickness and supporting a plurality of combing needles, wherein said support member is adapted to be affixed to the drafting machine for combing slivers of fibrous material, and said diameter of said support member defines a ratio with said thickness of said sleeve of between generally 8 and 6 to 1.

13. An assembly as set forth in claim 12, wherein said diameter of said support member is generally 7 mm.

14. An assembly as set forth in claim 12, wherein said thickness of said sleeve is generally 1 mm.

15. An assembly as set forth in claim 12, wherein said sleeve includes a rib and said combing needles are dispose in said rib.

16. An assembly as set forth in claim 12, wherein said sleeve defines an intermediate section and said rib defines a plane, said intermediate section forming an angle with said plane of between generally 40° and 55°.

17. An assembly as set forth in claim 16, wherein said sleeve defines an intermediate section and said rib defines a plane, said intermediate section forming an angle with said plane of generally 45°.

18. An assembly as set forth in claim 12, wherein said sleeve defines an intermediate section and said rib defines a plane, said intermediate section forming an angle with said plane of between generally 40° and 55°.

19. An assembly as set forth in claim 12, wherein said intermediate section defines a corner on said sleeve wall.

20. An assembly as set forth in claim 12, wherein said diameter of said support member defines a ratio with said thickness of said sleeve of generally 7 to 1.

* * * * *

US007159280C1

(12) INTER PARTES REEXAMINATION CERTIFICATE (600th)

United States Patent
Voshell, Sr. et al.

(10) Number: US 7,159,280 C1
(45) Certificate Issued: May 13, 2013

(54) DISPOSABLE FALLER BAR WITH IMPROVED CORE

(75) Inventors: William E. Voshell, Sr., Ringgold, GA (US); Keith Battersby, Low Moor Bradford (GB); Colin Rhodes, Low Moor Bradford (GB)

(73) Assignees: Marriner Import Export, Chattanooga, TN (US); Fallers International Ltd., Laist Bradford, Yorkshire (GB)

Reexamination Request:
No. 95/000,356, Mar. 6, 2008

Reexamination Certificate for:

| | |
|---|---|
| Patent No.: | **7,159,280** |
| Issued: | **Jan. 9, 2007** |
| Appl. No.: | **10/969,261** |
| Filed: | **Oct. 20, 2004** |

Related U.S. Application Data

(60) Provisional application No. 60/512,722, filed on Oct. 20, 2003.

(51) Int. Cl.
*D01H 5/04* (2006.01)

(52) U.S. Cl.
USPC ..... 19/129 R; 19/129 A

(58) Field of Classification Search
None
See application file for complete search history.

(56) References Cited

To view the complete listing of prior art documents cited during the proceeding for Reexamination Control Number 95/000,356, please refer to the USPTO's public Patent Application Information Retrieval (PAIR) system under the Display References tab.

*Primary Examiner* — Catherine S. Williams

(57) ABSTRACT

A faller bar assembly includes a support member that defines a generally annular shaft. A sleeve defines a tubular wall with a generally annular opening and receives the generally annular shaft. The sleeve includes a rib that projects outwardly from the tubular wall and supports a plurality of combing needles. The rib includes a rib wall disposed within a plane defined by an axis of the generally annular opening. The rib wall defines an intermediate surface with the tubular wall having an angle of between 40 and 55 degrees to the plane defined by the axis.

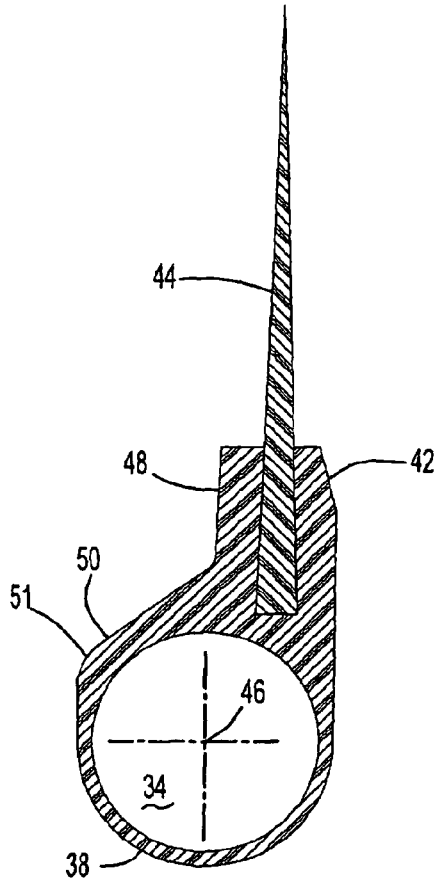

INTER PARTES REEXAMINATION CERTIFICATE ISSUED UNDER 35 U.S.C. 316

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 12-20 is confirmed.

Claims 2, 8 and 10 are cancelled.

Claims 1 and 9 are determined to be patentable as amended.

Claims 3-7 and 11, dependent on an amended claim, are determined to be patentable.

1. A faller bar assembly, comprising:

a support member defining a generally annular shaft;

a sleeve defining tubular wall with a generally annular opening for receiving said generally annular shaft;

said sleeve including a rib projecting outwardly from said tubular wall and having a plurality of combing needles spaced therealong; [and]

wherein said rib includes a rib wall disposed within a plane defined by an axis of said generally annular opening, said rib wall defining an intermediate surface with said tubular wall having an angle of between generally 40° and 55° to said plane defined by said axis*, and*

*said tubular wall includes a wall thickness of between generally 1.1 mm and generally 0.9 mm*.

9. An assembly as set forth in claim [8] *1*, wherein said shaft includes a shaft diameter of between generally 6.2 mm to generally 7.0 mm.

* * * * *